US011069270B2

(12) United States Patent
Kobayashi

(10) Patent No.: US 11,069,270 B2
(45) Date of Patent: Jul. 20, 2021

(54) CONTROL CIRCUIT, DRIVE CIRCUIT, ELECTRO-OPTICAL DEVICE, ELECTRONIC APPARATUS INCLUDING ELECTRO-OPTICAL DEVICE, MOVABLE BODY INCLUDING ELECTRONIC APPARATUS, AND ERROR DETECTION METHOD

(71) Applicant: Seiko Epson Corporation, Tokyo (JP)

(72) Inventor: Hironori Kobayashi, Chino (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/855,032

(22) Filed: Apr. 22, 2020

(65) Prior Publication Data

US 2020/0342796 A1 Oct. 29, 2020

(30) Foreign Application Priority Data

Apr. 23, 2019 (JP) ..... JP2019-081741

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2320/0693* (2013.01)

(58) Field of Classification Search
CPC ..... G09G 3/006; G09G 3/20; G09G 3/2096; G09G 3/3648; G09G 5/00; G09G 2320/0693; G09G 2370/08
See application file for complete search history.

(56) References Cited

U.S. PATENT DOCUMENTS

| | | | |
|---|---|---|---|
| 7,872,627 B2 | 1/2011 | Fushimi | |
| 8,576,258 B2 | 11/2013 | Chen et al. | |
| 8,654,155 B2 | 2/2014 | Yu et al. | |
| 9,514,713 B2 | 12/2016 | Lee et al. | |
| 2012/0036418 A1 | 2/2012 | Morino et al. | |
| 2014/0068374 A1 | 3/2014 | Ha et al. | |
| 2017/0278441 A1* | 9/2017 | Ooki | G09G 3/3648 |

FOREIGN PATENT DOCUMENTS

| | | |
|---|---|---|
| JP | 4195589 B | 12/2008 |
| JP | 2012-035677 A | 2/2012 |
| JP | 5670117 B | 2/2015 |
| JP | 2016-161729 A | 9/2016 |
| JP | 2017-054306 A | 3/2017 |

* cited by examiner

*Primary Examiner* — Nelson M Rosario
(74) *Attorney, Agent, or Firm* — Harness, Dickey & Pierce, P.L.C.

(57) ABSTRACT

In a control circuit 500, a data transmission circuit 503 transmits image data Dp, and a code generation circuit 511 generates a first code CDa from the image data Dp. In a data line drive circuit 200, which is a drive signal generation circuit, a data reception circuit 201 receives the image data Dp, a code generation circuit 203 generates a second code CDb from the image data Dp, and a code transmission circuit 204 transmits the generated code as a code CDc. In the control circuit 500, a code reception circuit 512 receives the code CDc and outputs the received code CDc as the second code CDd, a comparison circuit 521 of an error detection circuit 520 detects an error in the image data DP received data line drive circuit 200 based on the first code CDa and the second code CDd.

4 Claims, 5 Drawing Sheets

CONTROL CIRCUIT, DRIVE CIRCUIT, ELECTRO-OPTICAL DEVICE, ELECTRONIC APPARATUS INCLUDING ELECTRO-OPTICAL DEVICE, MOVABLE BODY INCLUDING ELECTRONIC APPARATUS, AND ERROR DETECTION METHOD

The present application is based on, and claims priority from JP Application Serial Number 2019-081741, filed Apr. 23, 2019, the disclosure of which is hereby incorporated by reference herein in its entirety.

BACKGROUND

1. Technical Field

This invention relates to a control circuit that transmits data to a circuit to be controlled, such as a drive signal generation circuit of an electro-optical device.

2. Related Art

Electro-optical devices have been applied to a wide range of uses, including automotive uses, which has led to stricter safety demands. JP-A-1-2012-35677 discloses a technology in which a display output control unit of a display control device includes a superimposition control unit and a comparison control unit. The superimposition control unit superimposes image data of a plurality of planes, namely plane 1 to plane n, and composites image data to be supplied to the display device. Note that n is an integer of 2 or above. The comparison control unit executes a cyclic redundancy check for any regions of image data to be supplied to the display device. With the technology disclosed in JP-A-1-2012-35677, it is possible to detect errors that occur in any region of image data that is to be supplied to the display device.

JP-A-1-2012-35677 is an example of the related art.

However, with the technology disclosed in JP-A-1-2012-35677, it is not possible to detect errors that arise from abnormalities occurring in the device to be controlled that receives image data from the display control device. Examples of abnormalities that may occur in the device to be controlled include an abnormality in the input terminal of a drive signal generation circuit that generates a drive signal for the display device, an abnormality in an image data reception circuit of the drive signal generation circuit, and an abnormality such as a disconnection occurring in a signal line that runs from a display control device to the drive signal generation circuit. A problem with the technology disclosed in JP-A-1-2012-35677 is that errors in image data received by the drive signal generation circuit cannot be detected if said errors arise from abnormalities such as those described above.

SUMMARY

A control circuit according to a mode of the present disclosure includes: a code generation circuit configured to generate a first code from image data; a transmission unit configured to transmit the image data to a drive signal generation circuit that is configured to generate a drive signal for a display device; a reception unit that is configured to receive a second code regarding an error in the image data to be received by the drive signal generation circuit; and an error detection unit configured to detect an error in the image data received by the drive signal generation circuit, based on the first code and the second code.

Also, a drive circuit according to a mode of the present disclosure includes: a control circuit configured to transmit image data, and to generate a first code from the image data; and a drive signal generation circuit configured to receive the image data, and to generate a second code from the received image data and transmit the generated second code to the control circuit, wherein the control circuit detects an error in the image data received by the drive signal generation circuit, based on the first code and the second code.

Also, an error detection method according to a mode of the present disclosure includes the steps of: a transmission device transmitting image data and generating a first code from the transmitted data; a reception device receiving the image data, generating a second code from the received image data, and transmitting the generated second code to the transmission device; and the transmission device detecting an error in the image data received by the reception unit based on the first code and the second code.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
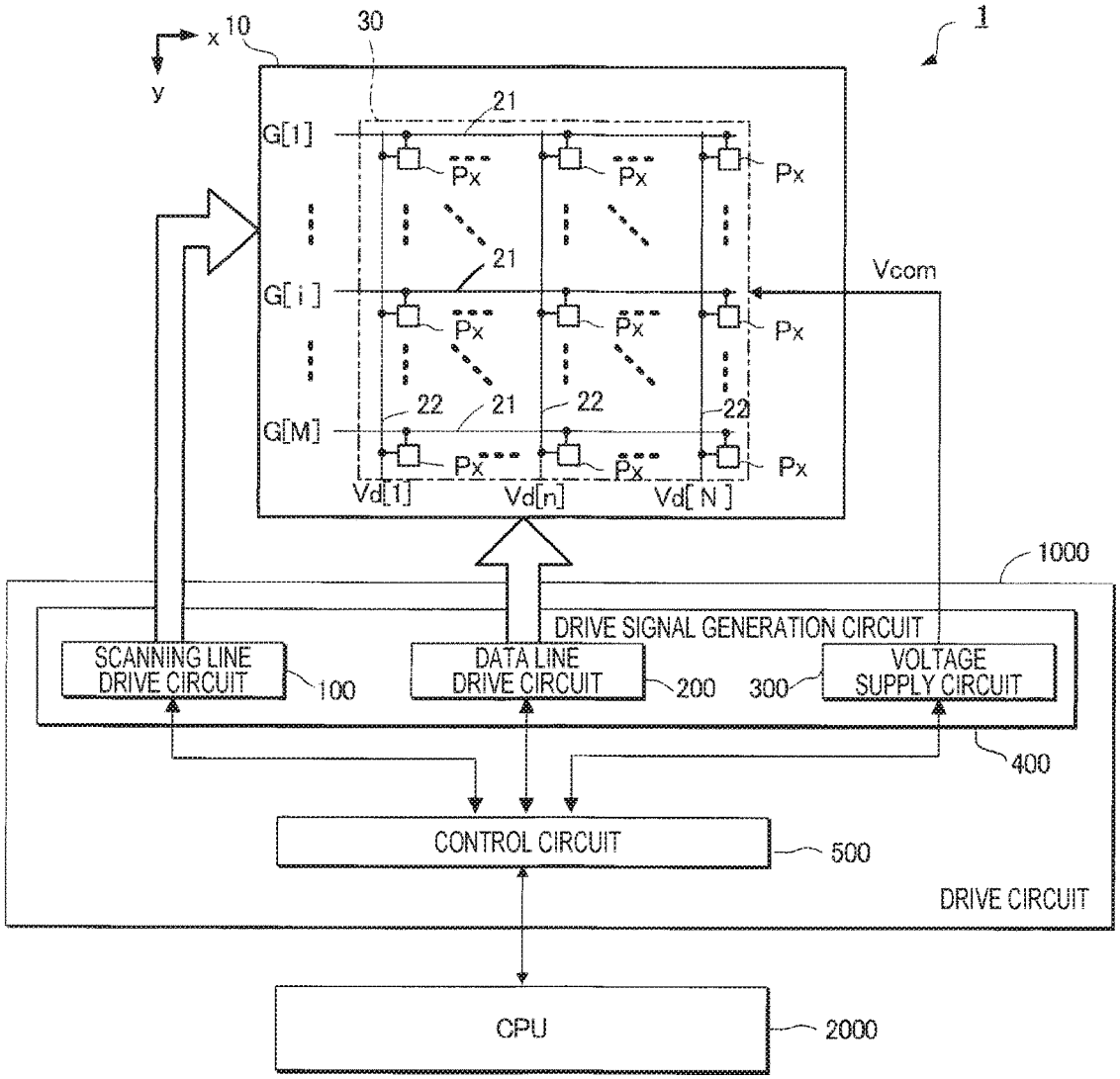
FIG. 1 is a block diagram showing a configuration of an electro-optical device that includes a control circuit that is an embodiment.

The following are descriptions of embodiments with reference to the drawings. Note that, the sizes and scale of the components shown in the drawings have been changed from the sizes and scale of the actual components as appropriate. Also, the embodiments in the following description are subject to various technically preferable limitations, but the embodiments are not limited thereto.

A. First Embodiment

FIG. 1 is a block diagram of an electro-optical device 1 that includes a control circuit 500 that is a first embodiment. An electro-optical device 1 includes an electro-optical panel 10, a drive circuit 1000 that drives the electro-optical panel 10, and a CPU (Central Processing Unit) 2000 that controls the drive circuit 1000. The electro-optical device 1 is a device that uses an electro-optical medium whose optical characteristics are changed by electrical energy. Examples of the electro-optical material include liquid crystal, an organic electroluminescent material, and a charged substance that is used in an electrophoresis element. The present embodiment describes an electro-optical panel that uses liquid crystal as the electro-optical material.

In the electro-optical panel 10, the axis along which scanning lines 21 run is the x-axis, and the axis that is orthogonal to the x-axis is the y-axis. The electro-optical panel 10 includes 1st to M-th rows of the scanning lines 21 extending along the x-axis, and 1st to N-th columns of data lines 22 extending along the y-axis. Note that M and N are natural numbers. In the electro-optical panel 10, pixel circuits Px are arranged in a matrix of M rows vertically and N columns horizontally, at positions where the scanning lines 21 and the data lines 22 intersect with each other.

As shown in FIG. 1, the drive circuit 1000 includes the control circuit 500 according to the present embodiment and a drive signal generation circuit 400 that is a circuit to be controlled by the control circuit 500. The drive circuit 1000 is supplied with input image data and control signals from the CPU 2000. Here, the input image data includes data for regulating tones to be displayed by the pixel circuits Px. For example, the input image data may also be 8-bit digital data for regulating tones to be displayed by the pixels. Also, the control signals include synchronizing signals such as a vertical synchronizing signal Vsync and a horizontal synchronizing signal Hsync. The control signals and the input image data described above are input to the control circuit 500.

The vertical synchronizing signal Vsync is a synchronizing signal for instructing the start of a vertical scanning period, and is a vertical start pulse signal that includes one pulse at the start of the vertical scanning period. Also, the horizontal synchronizing signal Hsync is a synchronizing signal for instructing the start of a horizontal scanning period, and is a horizontal start pulse signal that includes one pulse at the start of the horizontal scanning period.

Based on synchronizing signals supplied from the CPU 2000, the control circuit 500 generates various types of control signals to control the drive signals generation circuit 400. Also, the control circuit 500 generates image data that indicates an image to be displayed on the electro-optical panel 10 based on input image data supplied from the CPU 2000, and outputs the generated image data to the drive signal generation circuit 400.

The drive signal generation circuit 400 is a circuit that performs signal generation processing to generate drive signals for driving the electro-optical panel 10. The drive signal generation circuit 400 includes a scanning line drive circuit 100, a data line drive circuit 200, and a voltage supply circuit 300.

The voltage supply circuit 300 is a circuit that outputs various types of voltage as drive signals, such as a common voltage to a common electrode 30 of the electro-optical panel 10, a power source voltage to the scanning line drive circuit 100, and a power source voltage to the data line drive circuit 200.

The scanning line drive circuit 100 is a circuit that drives the M scanning lines 21 in the electro-optical panel 10. The control circuit 500 receives the vertical synchronizing signal Vsync and the horizontal synchronizing signal Hsync from the CPU 2000 and supplies the received synchronizing signals to the scanning line drive circuit 100. Whenever the scanning line drive circuit 100 is given the vertical synchronizing signal Vsync, the scanning line drive circuit 100 sequentially selects the M scanning lines 21 in synchronization with the horizontal synchronizing signal Hsync, and sets a scanning signal for the selected scanning lines 21 to an active level.

The data line drive circuit 200 is a circuit that drives the N data lines 22 in the electro-optical panel 10. The control circuit 500 receives the vertical synchronizing signal Vsync and the horizontal synchronizing signal Hsync from the CPU 2000 and supplies the synchronizing signals to the data line drive circuit 200. Whenever the data line drive circuit 200 is given a vertical synchronizing signal Vsync, the data line drive circuit 200 receives 1 frame worth of image data Dp from the control circuit 500. Also, whenever the data line drive circuit 200 is given the horizontal synchronizing signal Hsync in the process of receiving 1 frame worth of the image data Dp, the data line drive circuit 200 performs D/A conversion on 1 line worth of image data from M lines worth of image data that constitutes 1 frame worth of the image data Dp, and repeatedly outputs the converted image to data to the N data lines 22 as analogue data signals Vd[n]. Note that n is a natural number from 1 to N. The control circuit 500 includes a function for detecting errors in the image data Dp received by the data line drive circuit 200. Note that the details of this error detection function will be described later.

Figure 2:
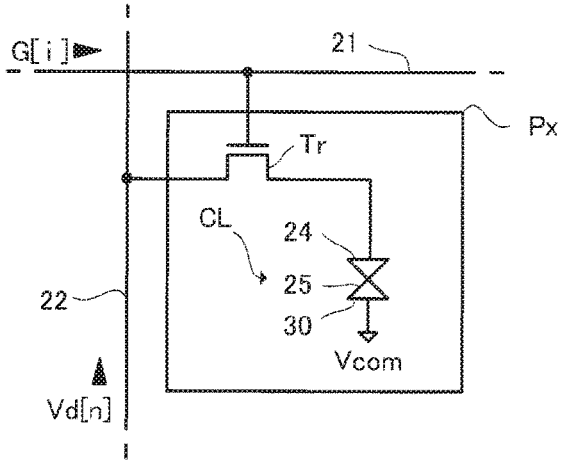
FIG. 2 is a diagram showing a configuration of a pixel circuit in the same embodiment.

FIG. 2 is a circuit diagram of one of the pixel circuits Px that are provided in the electro-optical panel 10. As shown in FIG. 2, each of the pixel circuits Px includes a liquid-crystal element CL and a writable transistor Tr. The liquid-crystal element CL includes the common electrode 30, a pixel electrode 24, and liquid crystal 25 that is provided between the common electrode 30 and the pixel electrode 24. Here, the common electrode 30 faces the pixel electrodes 24 of all of the pixels on the electro-optical panel 10. A common voltage VCOM that is supplied from the voltage supply circuit 300 is applied to the common electrode 30. The transmittance of the liquid crystal 25 of the liquid crystal element CL changes depending on the voltage applied to the liquid crystal element CL, or more specifically the voltage applied between the common electrode 30 and the pixel electrode 24.

In the present embodiment, the write transistors Tr are N-channel transistors whose gates are coupled to the scanning lines 21 and are provided between the liquid-crystal elements CL and the data lines 22 and control the electrical connection between them. That is to say, the write transistors Tr perform control to electrically connect or disconnect the liquid-crystal elements CL and the data lines 22. If a scanning signal G[i], which is a drive signal, is set to the active level, the write transistors Tr of the pixel circuits Px on the i-th row simultaneously transition to an on-state. Note that i is a natural number from 1 to M.

At the timing at which the scanning lines 21 corresponding to a certain pixel circuit Px is selected and the write transistor Tr of that pixel circuit Px is turned on, the data signal Vd[n], which is a drive signal, is supplied from the data line 22 to that pixel circuit Px. As a result, the liquid crystal 25 of that pixel circuit Px is set to a transmittance that corresponds to the data signal Vd[n], and therefore the pixel that corresponds to that pixel circuit Px displays a tone that corresponds to the data signal Vd[n].

Figure 3:
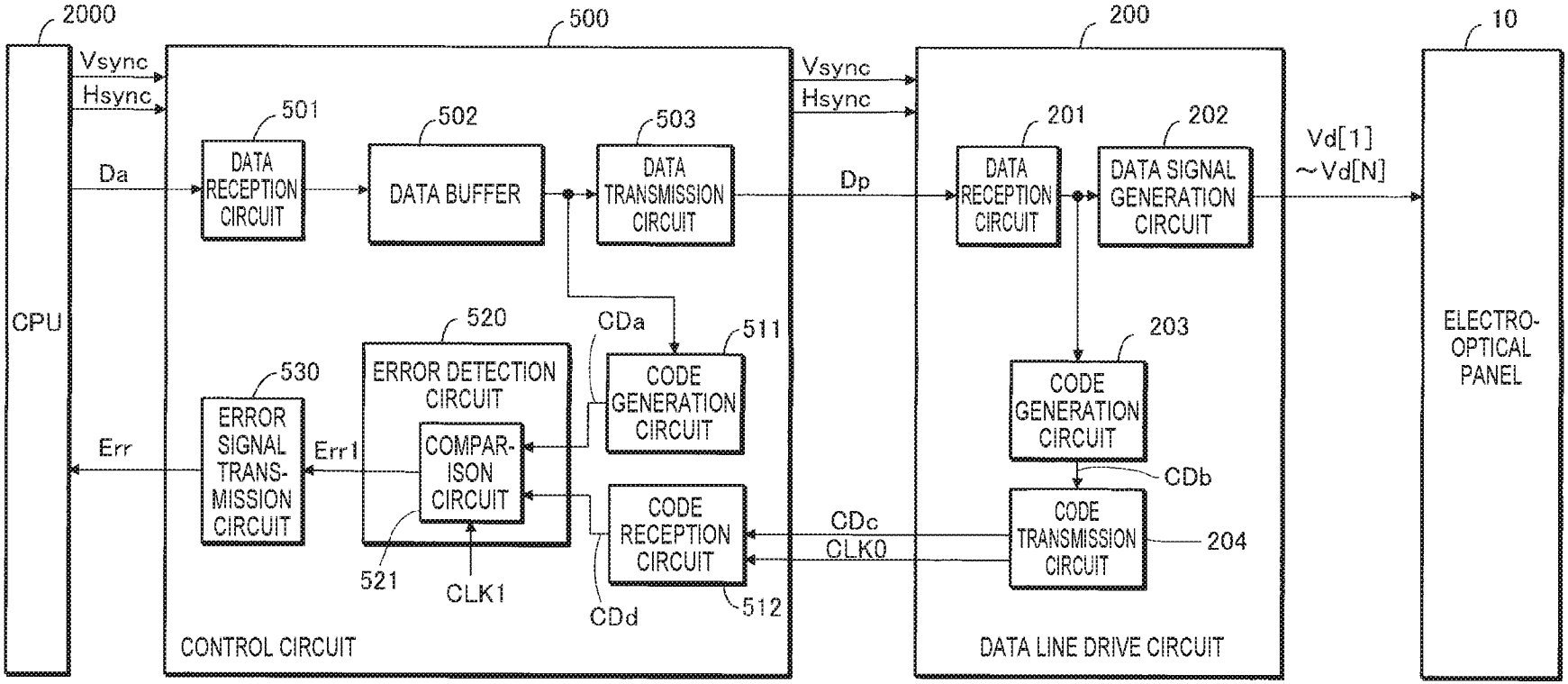
FIG. 3 is a block diagram showing a configuration of a control circuit and a data line drive circuit in the same embodiment.

FIG. 3 is a block diagram showing a configuration of the control circuit 500 and the data line drive circuit 200. Note that FIG. 3 shows the CPU 2000 and the electro-optical panel 10 along with the control circuit 500 and the data line drive circuit 200 for the sake of convenience.

The control circuit 500 includes a data reception circuit 501, a data buffer 502, a data transmission circuit 503, a code generation circuit 511, a code reception circuit 512, an error detection circuit 520, and an error signal transmission circuit 530.

The data reception circuit 501 receives image data Da from the CPU 2000 and stores the received data in the data buffer 502. Whenever the vertical synchronizing signal Vsync is input, the data transmission circuit 503 retrieves 1 frame worth of image data from the data buffer 502 and transmits the retrieved image data to the data line drive circuit 200 as the image data Dp showing what is to be displayed on the electro-optical panel 10. The code generation circuit 511 generates a first code CDa, which is an error detection code, from the 1 frame worth of the image data Dp that is to be transmitted. In the present embodiment, the first code CDa is a CRC (Cyclic Redundancy Check) code.

The following describes a configuration of the data line drive circuit 200. Note that in order to avoid repeated descriptions, the code reception circuit 512, the error detection circuit 520 and the error signal transmission circuit 530 of the control circuit 500 will be described after the description of the configuration of the data line drive circuit 200.

The data line drive circuit 200 includes a data reception circuit 201, a data signal generation circuit 202, a code generation circuit 203, and a code transmission circuit 204. Whenever the vertical synchronizing signal Vsync is input, the data reception circuit 201 receives 1 frame worth of the image data Dp from the control circuit 500. If the electro-optical panel 10 is made up of M rows and N columns of pixels, then the 1 frame worth of the image data Dp is M lines worth of image data showing the tones to be displayed by the pixels corresponding to each of the M scanning lines 21. Also, 1 line worth of image data is N pixels worth of image data showing the tones to be displayed by the N pixels corresponding to 1 of the scanning lines 21.

In synchronization with the horizontal synchronizing signal Hsync, the data signal generation circuit 202 repeatedly generates the data signals Vd[n] to be output to the N data lines 22. To give a more detailed description, the horizontal synchronizing signal Hsync is input, the data signal generation circuit 202 performs D/A conversion on the newest 1 line worth=N pixels worth of image data in the image data Dp that has been received by the data reception circuit 201, and generates the data signals Vd[n] to be output to the N data lines 22.

Whenever the data reception circuit 201 receives 1 frame worth of the image data Dp, the code generation circuit 203 generates a second code CDb, which is an error detection code, from the 1 frame worth of the image data Dp. The second code CDb is a CRC code, similarly to the first code CDa. In the present embodiment, the algorithm with which the code generation circuit 203 generates the second code CDb from the image data Dp is the same as the algorithm with which the code generation circuit 511 generates the first code CDa from the image data Dp. Accordingly, if the image data Dp that is used to generate the second code CDb is the same as the image data Dp used to generate the first code CDa, that is, if the data reception circuit 201 receives the image data Dp without error, the second code CDb matches the first code CDa. On the other hand, if an abnormality in the input terminal of the data line drive circuit 200, an abnormality in the data reception circuit 201, or an abnormality such as a disconnected signal line from the control circuit 500 to the data line drive circuit 200 occurs, the second code CDb does not match the first code CDa.

Whenever the code generation circuit 203 generates the second code CDb from 1 frame worth of the image data Dp, the code transmission circuit 204 converts the second code CDb into a code CDc, which is a serial bit string, and transmits the bits that constitute the code CDc to the code generation circuit 203 in synchronization with the clock CLK0.

The present description will now return to the configuration of the control circuit 500. The code reception circuit 512 captures the bits that constitute the code CDc with use of the clock CLK0, converts the captured bits to a code CDd, which is parallel data, and outputs the converted code. The code CDd is the second code CDb obtained in the data line drive circuit 200 that has been parallel-serial converted and furthermore serial-parallel converted, and the content thereof is assumed to be the same as the second code CDb. The code CDd will be referred to as a second code CDd hereinafter.

The error detection circuit 520 includes a comparison circuit 521. The comparison circuit 521 detects errors in the image data Dp received by the data line drive circuit 200 from the control circuit 500, based on the first code CDa generated by the code generation circuit 511 and the second code CDd output by the code reception circuit 512. To give a more detailed description, in accordance with a clock CLK1 that is input at a timing after a predetermined period of time has passed from the timing at which the code reception circuit 512 outputs the second code CDd, the comparison circuit 521 compares the first code CDa and the second code CDd with each other and outputs an error signal Err1 if the codes do not match.

The error signal transmission circuit 530 may also generate a combined error signal Err based on the error signal Err1 generated by the error detection circuit 520 and another error signal generated in relation to the drive signal generation circuit 400, and transmit the combined error signal Err to the CPU 2000. In another preferable embodiment, the error signal transmission circuit 530 transmits the logical sum of the error signal Err1 and the other error signal as the combined error signal Err. Also, in another preferable embodiment, the error signal transmission circuit 530 transmits a time-multiplexed signal of the error signal Err1 and the other error signal as the combined error signal Err. Note that a detailed description of the other error signal is omitted in the present embodiment.

The CPU 2000 detects that an error has occurred in the drive circuit 1000 based on the error signal Err, and executes processing corresponding to the abnormality. Abnormalities can be processed in a variety of different ways, but if an occurrence frequency per unit time of the error signal Err is obtained, and the occurrence frequency exceeds a predetermined threshold, the CPU 2000 may also perform control such that an error message indicating that an abnormality has occurred in the drive signal generation circuit 400 is displayed on the electro-optical panel 10. Thus, the user is notified of the abnormality of the drive signal generation circuit 400, and any necessary tasks such as repairing or replacing the applicable circuit can be performed.

Figure 4:
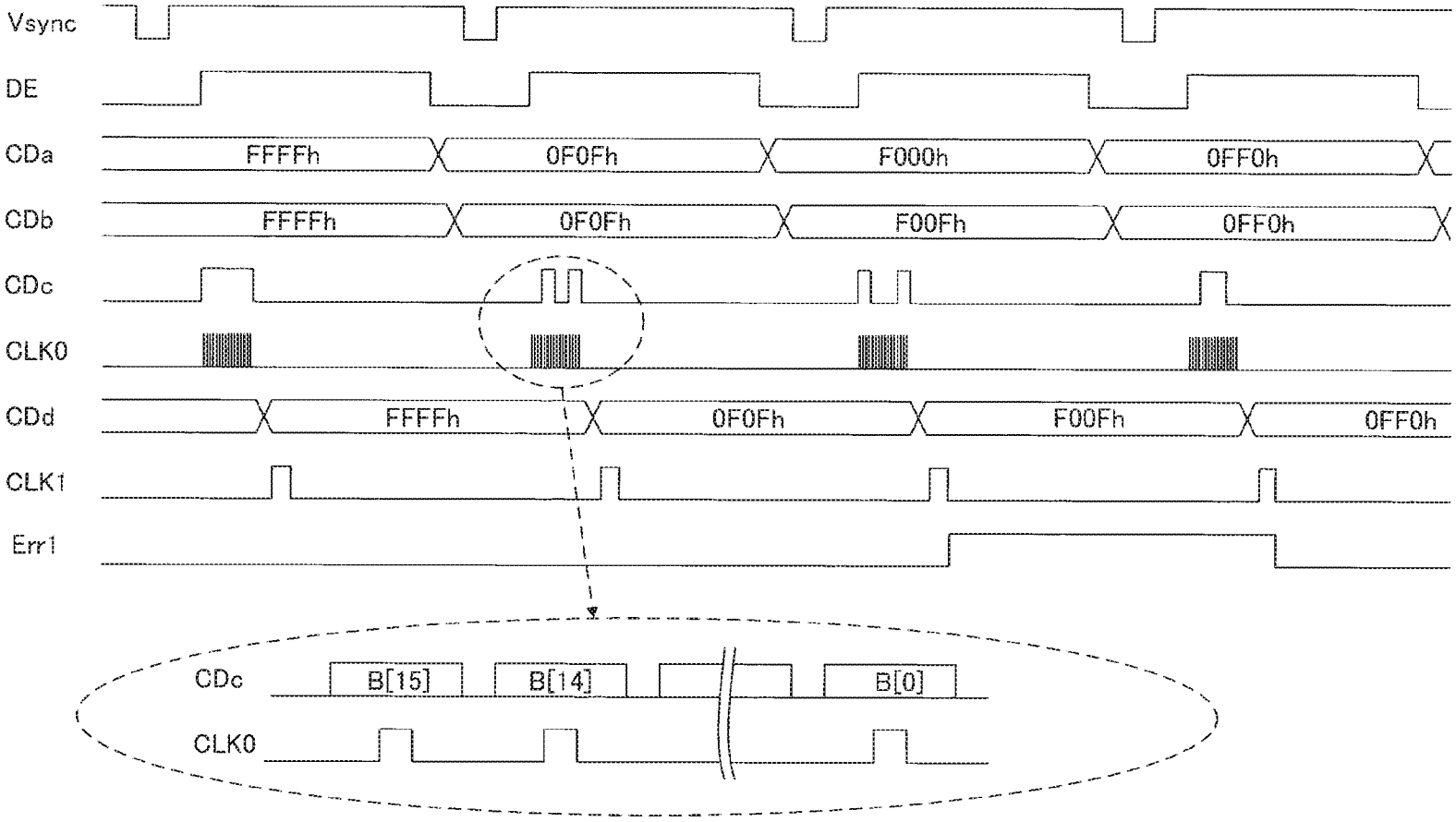
FIG. 4 is a time chart showing operations of the same embodiment.

FIG. 4 is a time chart showing operations of the present embodiment. The following is a description of the present embodiment with reference to FIG. 4. Whenever the vertical synchronizing signal Vsync, which is a negative pulse, is input to the control circuit 500, the data transmission circuit 503 reads out 1 frame worth of image data from the data buffer 502 and transmits the read out image data to the data line drive circuit 200 as the image data Dp. Also, while transmitting the 1 frame worth of data of the image data Dp, the data transmission circuit 503 transmits an H level data enable signal DE, which shows that the image data Dp is enabled, to the data line drive circuit 200. Also, whenever the vertical synchronizing signal Vsync is input to the control circuit 500, the code generation circuit 511 generates the first code CDa, which is a CRC code, from 1 frame worth of the image data DP that is to be transmitted by the data transmission circuit 503.

In the example shown in FIG. 4, in accordance with the input of the first to fourth vertical synchronizing signals Vsync, 1 frame worth of the image data Dp is transmitted for each of the vertical synchronizing signals Vsync, and the codes FFFFh, 0F0Fh, F000h, and 0FF0h are generated from the corresponding image data Dp as the first code CDa. Here, h means hexadecimal notation. The first code CDa is 16-bit parallel data.

Whenever the vertical synchronizing signal Vsync is input, the data reception circuit 201 transmits 1 frame worth of the image data Dp that was sent from the control circuit 500 while the data enable signal DE is H level. Whenever the vertical synchronizing signals Vsync is input, the code generation circuit 203 generates the second code CDb, which is a CRC code, from the 1 frame worth of the image data Dp received by the data reception circuit 201. The second code CDb is 16 bit parallel data, similarly to the first code CDa. Whenever the code generation circuit 203 generates the second code CDb, the code transmission circuit 204 converts the second code CDb into the code CDc, which is a 16-bit serial bit string, and transmits the bits B[15], B[14], . . . , and B[0] of the code CDc to the code generation circuit 203 in synchronization with the clock CLK0.

In the example shown in FIG. 4, in accordance with the input of the first to fourth vertical synchronizing signals Vsync, 1 frame worth of the image data Dp is received for each of the vertical synchronizing signals Vsync, and the codes FFFFh, 0F0Fh, F000h, and 0FF0h are generated from the corresponding image data Dp, as the second code CDb. Then, the second code CDb is converted into the code CDc, which is a serial bit string, and is transmitted to the control circuit 500.

In the control circuit 500, the code reception circuit 512 retrieves the bits that constitute the code CDc with use of the clock CLK0, and outputs the captured bits as the second code CDd, which is 16-bit parallel data. The second code CDd corresponds to the second code CDb generated by the code generation circuit 203 of the data line drive circuit 200.

In the example shown in FIG. 4, the codes FFFFh, 0F0Fh, F000h, and 0FF0h are each output from the code reception circuit 512 as the second code CDd. These codes correspond to the second code CDb generated from the image data DP received in accordance with the first to fourth vertical synchronizing signals Vsync in the data line drive circuit 200.

Upon receiving the clock CLK1, the error detection circuit 520 compares the first code CDa output by the code generation circuit 511 with the second code CDd output by the code reception circuit 512, and outputs an H level error signal Err if the compared codes do not match. In the example shown in FIG. 4, in accordance with the third vertical synchronizing signal Vsync, the first code CDa output by the code generation circuit 511 is F000h and the second code CDd output by the code reception circuit 512 is F00Fh, and thus the H level error signal Err1 is output because the output codes do not match. In this way, in the present embodiment, if an error occurs in the image data Dp received by the data line drive circuit 200, the error is detected by the control circuit 500.

As described above, the control circuit 500 according to the present embodiment includes: the code generation circuit 511 configured to generate a first code CDa from image data Dp; the data transmission circuit 503 configured to transmit the image data Dp to the data line drive circuit 200 that is a circuit to be controlled; the code reception circuit 512 that is configured to receive the second code CDd regarding an error in the image data Dp generated by the data line drive circuit 200; and the error detection circuit 520 configured to detect an error in the image data Dp received by the data line drive circuit 200, based on the first code CDa and the second code CDd, and therefore the control circuit 500 can detect errors in the image data Dp received by the data line drive circuit 200, which is he circuit to be controlled.

Also, with the present embodiment, the circuit to be controlled is the drive signal generation circuit 400 that generates a drive signal for the electro-optical panel 10 of the electro-optical device 1, or more specifically the data line drive circuit 200, and it is thus possible to improve the reliability of the electro-optical device 1 because the error in the image data received by the data line drive circuit 200 is detected.

Also, with the present embodiment, the control circuit 500 is provided with the error signal transmission circuit 530 that transmits an error signal indicating an error in the image data, and thus it is possible for an external device such as the CPU 2000 that controls the control circuit 500 to execute processing according to the error in the image data.

Also, with the present embodiment, the error detection circuit 520 detects errors in the image data with the use of the comparison circuit 521 that compares the second code CDd to the first code CDa. Also, in the present embodiment, the first code CDa and the second code CDd include CRC codes. Accordingly, with the present embodiment, it is possible to improve the reliability of error detection related to the image data DP received by the data line drive circuit 200. In the present embodiment, detailed descriptions have been given for the control circuit 500, the drive signal generation circuit 400, and the data line drive circuit 200, all of which are components of the electro-optical panel that uses liquid crystal as the electro-optical material thereof, but configurations are also possible in which the control circuit 500 is a TCON (Timing Controller) that transmits the image data Dp, the drive signal generation circuit 400 is a liquid crystal driver (Driver), and the data line drive circuit 200 is a liquid crystal drive source driver (Source Driver).

As a comparative example for comparison with the present embodiment, a mode can also be envisioned in which the control circuit generates an error detection code from image data, adds the error detection code to the image data and sends the image data to the data line drive circuit, and error detection is performed on the image data in the data line drive circuit with use of the error detection code that had been added to the image data. In this mode, similarly to the present embodiment, it is possible to detect an error in the image data received by the data line drive circuit. However, in this mode, in addition to the circuit for generating an error detection code from image data, and it is necessary to provide the data line drive with a circuit that compares the error detection code generated from the image data with the error detection code added to the image data, and thus there is a problem that this would lead to an increase in the size or complexity of the data line drive circuit. In contrast, in the present embodiment, in the control circuit, a first code is generated from image data and, the first code is compared with a second code, which has been received from a data line drive circuit. Accordingly, with the present embodiment, it is possible to detect errors in image data received by the data line drive circuit without leading to an increase in the size or complexity of the data line drive circuit.

B. Other Embodiments

Although embodiments have been described above, but other embodiments are also possible. Examples of other embodiments are described below.

(1) In the embodiments described above, the error detection code is generated from image data in units of 1 frame worth of data, but the unit of image data used to generate the error detection code may be any unit, and a configuration is also possible in which the error detection code is generated from image data in units of 1 line worth of image data.

(2) In the embodiments described above, the algorithm with which the code generation circuit 511 generates the first code CDa from the image data Dp is the same as the algorithm with which the code generation circuit 203 generates the second code CDb from the image data Dp, and the comparison circuit 521 compares the first code CDa with the second code CDb in order to detect errors in the image data Dp received by the data line drive circuit 200. However, the algorithm used to generate the first code CDa and the algorithm used to generate the second code CDb need not be the same algorithm. For example, the algorithm that is used to generate the second code CDb may also be set to generate the second code CDb that has the same absolute value as, but is the opposite sign of, the first code CDa from the same image data. In this case, it is sufficient that the error signal Err1 is generated in the error detection circuit 520 if the sum of the first code CDa and second code CDd corresponding to the second code CDb is numerical value other than 0. In this way, it is sufficient that the error detection circuit 520 detects errors in the image data Dp received by the data line drive circuit 200, based on the first code CDa and the second code CDd.

(3) In the embodiment described above, a liquid crystal display panel is used as the electro-optical panel 10, but embodiments are not limited thereto. The present disclosure can, for example, be applied to the electro-optical device 1 constituted by the electro-optical panel 10 that is a display other than a liquid crystal display panel, such as a display panel constituted by light emitting elements such as OLEDs (Organic Light-Emitting Diodes) and a display panel constituted by electrophoresis elements. Note that in the embodiments described above, an embodiment is given that includes one CPU 2000, but a configuration is also possible in which the output unit of the CPU 2000 that outputs to the control circuit 500 is separate from the input unit into which the error signal is input from the control circuit 500.

D. Example Applications

The electro-optical device 1 exemplified in the above modes can be used in various types of electronic apparatuses. FIGS. 5 to 8 illustrate specific modes of electronic apparatuses that have adopted the electro-optical device 1.

Figure 5:
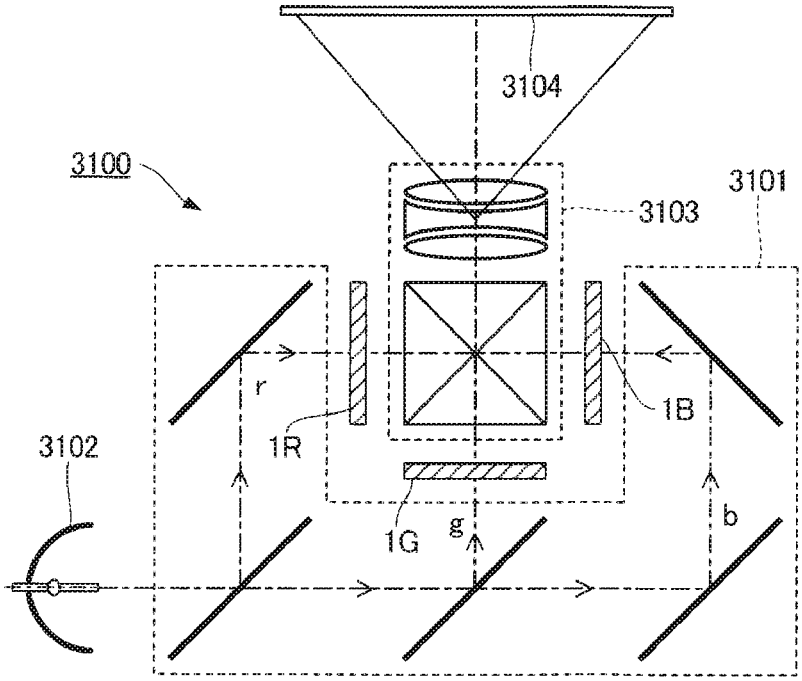
FIG. 5 is a schematic diagram of a projection-type display apparatus that is an example application.

FIG. 5 is a schematic diagram of a projection-type display device 3100 to which electro-optical devices 1R, 1G, and 1B are applied, each having a similar configuration to the electro-optical device 1. The projection-type display device 3100 includes three electro-optical devices 1R, 1G, and 1B corresponding to different display colors, specifically red, green, and blue. A lighting optical system 3101 supplies, a red component r of light emitted from a lighting device 3102 to the electro-optical device 1R, a green component g to the electro-optical device 1G, and a blue component b to the electro-optical device 1B. Each electro-optical device 1 functions as an optical modulator that modulates respective monochromatic light supplied from the lighting optical system 3101 according to a display image. The projection optical system 3103 combines the beams of light emitted from the respective electro-optical devices 1, and projects the combined light onto a projection surface 3104. An observer views the image projected on the projection surface 3104.

Figure 6:
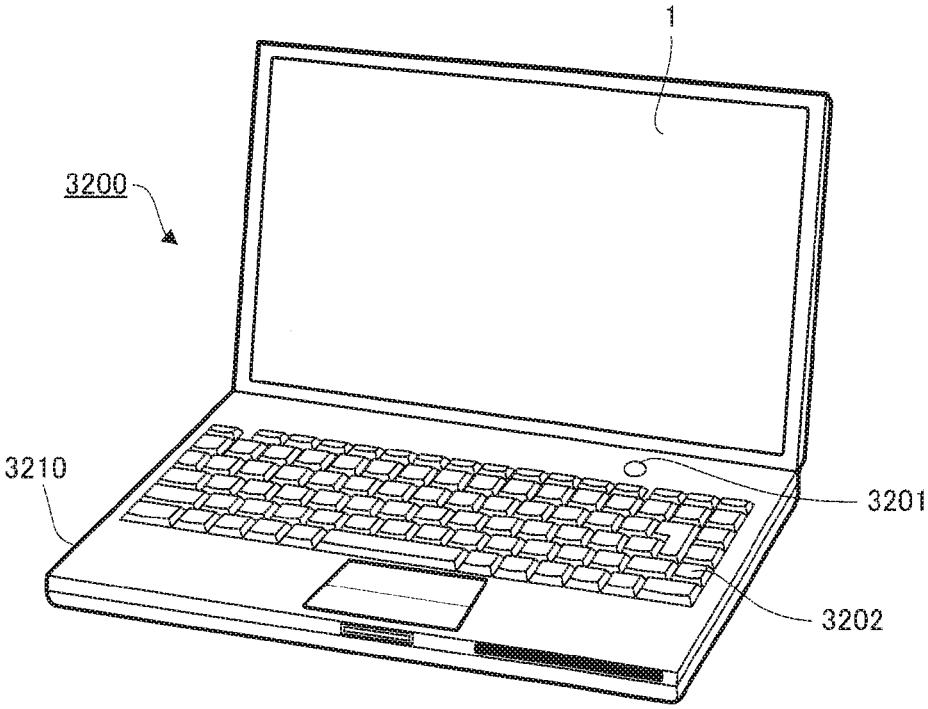
FIG. 6 is a schematic diagram of a personal computer that is an example application.

FIG. 6 is a perspective view of a portable personal computer 3200 that has adopted the electro-optical device 1. The personal computer 3200 includes the electro-optical device 1 that displays various types of images and a body portion 3210 in which a power switch 3201 and a keyboard 3202 are provided.

Figure 7:
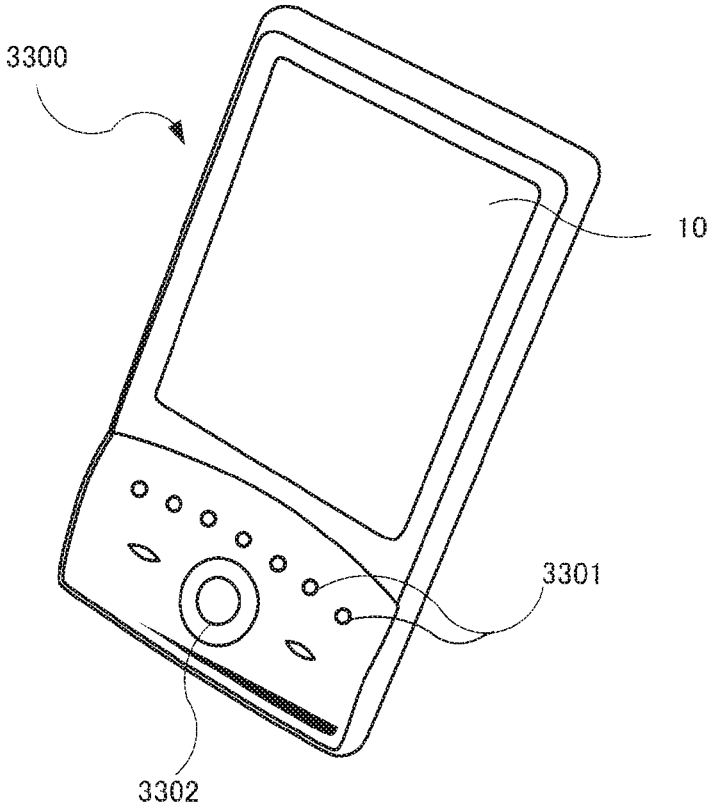
FIG. 7 is a schematic diagram of a mobile telephone that is an example application.

FIG. 7 is a diagram illustrating a configuration of a Personal Digital Assistant (PDA) to which the electro-optical device 1 has been applied. The information mobile terminal 3300 includes a plurality of operation buttons 3301, a power switch 3302, and the electro-optical device 1, which serves as a display unit. When the power switch 3302 is operated, various types of information such as an address book and a schedule book are displayed in the electro-optical device 1.

Besides the apparatuses illustrated in FIGS. 5 to 7, electronic apparatuses to which the electro-optical device 1 can be applied include, a digital multi-camera, a television, a video camera, an electronic organizer, electronic paper, a calculator, a word processor, a workstation, a video telephone, a POS (Point of Sale System) terminal, a printer, a scanner, a copier, a video player, an apparatus including a touch panel, and the like.

Figure 8:
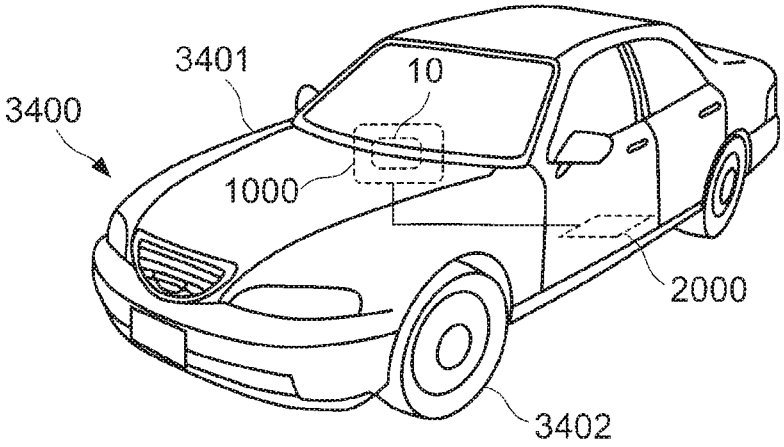
FIG. 8 is a schematic diagram of a movable body that is an example application.

FIG. 8 illustrates a configuration of a movable body to which the electro-optical device 1 has been applied. A movable body is an apparatus or a device that includes a drive mechanism such as an engine or a motor, a steering mechanism such as a steering wheel or a rudder, and various electronic apparatuses, for example, and moves over the ground, through the air, and on the sea. A car, an airplane, a motorcycle, a ship, a robot, or the like can be envisioned as the movable body. FIG. 8 schematically illustrates an automobile 3400 serving as a specific example of the movable body. The automobile 3400 includes an automotive body 3401 and wheels 3402. The electro-optical panel 10, the drive circuit 1000, and the CPU 2000 that controls the units of the automobile 3400 are incorporated in the automobile 3400. The CPU 2000 can include an ECU (Electronic Control Unit) or the like. The electro-optical panel 10 is a panel apparatus such as a meter panel. The CPU 2000 generates an image to be presented to a user, and transmits the image to the drive circuit 1000. The drive circuit 1000 displays the received image on the electro-optical panel 10. For example, information such as speed, remaining fuel, distance travelled, and settings of various devices are displayed as an image.

What is claimed is:

1. A control drive circuit comprising:

a control circuit controlled by a CPU, the control circuit having:

a first data reception circuit configured to receive first image data from the CPU;

a data transmission circuit configured to transmit second image data corresponding to the first image data;

a first code generation circuit configured to generate a first code directly corresponding to the first image data;

a code reception circuit configured to receive a second code; and an error detection circuit configured to compare the first code and the second code, determine whether an error exists in the second image data in response to a comparison result of the first code and the second code, and send an error detection result to the CPU; and a drive signal generation circuit configured to generate a drive signal for driving an optical panel and controlled by the CPU, the drive signal generation circuit having:

a second data reception circuit configured to receive the second image data from the data transmission circuit in the control circuit;

a data signal generation circuit configured to generate the drive signal based on the second image data;

a second code generation circuit configured to generate the second code directly corresponding to the second image data; and a code transmission circuit configured to transmit the second code to the code reception circuit in the control circuit, wherein the CPU is configured to control the control circuit and the drive signal generation circuit based on the error detection result.

2. The control unit according to claim 1, wherein each of the first code and the second code includes a CRC code.

3. An error detection method, comprising the steps of:

receiving first image data by a first data reception circuit in a control circuit, the control circuit being controlled by a CPU, the CPU sending the first image data to the control circuit;

generating a first code directly corresponding to the first image data by a first code generation circuit in the control circuit;

transmitting second image data corresponding to the first image data to a drive signal generation circuit by a data transmission circuit in the control circuit;

receiving the second image data from the data transmission circuit in the control circuit by a second data reception circuit in the drive signal generation circuit, the drive signal generation circuit being configured to generate a drive signal for driving an optical panel and controlled by the CPU;

generating the drive signal based on the second image data by a data signal generation circuit in the drive signal generation circuit;

generating a second code directly corresponding to the second image data by a second code generation circuit in the drive signal generation circuit;

transmitting the second code to the control circuit by a code transmission circuit in the drive signal generation circuit; and comparing the first code and the second code, determining whether an error exists in the second image data in response to a comparison result of the first code and the second code, and sending an error detection result to the CPU by an error detection circuit in the control circuit, wherein the CPU is configured to control the control circuit and the drive signal generation circuit based on the error detection result.

4. The error detection method according to claim 3, wherein each of the first code and the second code includes a CRC code.

* * * * *